US006257840B1

(12) United States Patent
Ignatiev et al.

(10) Patent No.: US 6,257,840 B1
(45) Date of Patent: Jul. 10, 2001

(54) SCROLL COMPRESSOR FOR NATURAL GAS

(75) Inventors: Kirill M. Ignatiev; James F. Fogt, both of Sidney; Kenneth L. Feathers, West Milton, all of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/435,532

(22) Filed: Nov. 8, 1999

(51) Int. Cl.[7] ..... F04B 49/00
(52) U.S. Cl. ..... 417/310; 418/55.6
(58) Field of Search ..... 418/1, 84, 55.1, 418/55.6, 55.5; 417/310, 371, 32, 250; 62/470

(56) References Cited

U.S. PATENT DOCUMENTS

| | | | | |
|---|---|---|---|---|
| Re. 35,216 | * | 4/1996 | Anderson et al. | 417/310 |
| 2,846,138 | | 8/1958 | Racklyeft . | |
| 3,291,385 | | 12/1966 | Williams et al. . | |
| 3,304,697 | | 2/1967 | Ramsey . | |
| 3,848,422 | | 11/1974 | Schibbye . | |
| 3,978,685 | | 9/1976 | Taylor . | |
| 4,086,041 | * | 4/1978 | Takeda | 415/84 |
| 4,105,374 | | 8/1978 | Scharf . | |
| 4,343,599 | | 8/1982 | Kousokabe . | |
| 4,553,906 | | 11/1985 | Boller et al. . | |
| 4,780,061 | * | 10/1988 | Butterworth | 417/371 |
| 5,001,908 | * | 3/1991 | Mayer | 62/470 |
| 5,033,944 | * | 7/1991 | Lassota | 418/1 |
| 5,037,278 | | 8/1991 | Fujio et al. . | |
| 5,286,179 | | 2/1994 | Forni et al. . | |
| 5,372,490 | * | 12/1994 | Fain | 418/55.6 |
| 5,466,136 | | 11/1995 | Yamada et al. . | |
| 5,667,371 | * | 9/1997 | Prenger et al. | 418/55.1 |
| 5,707,210 | * | 1/1998 | Ramsey et al. | 417/32 |
| 5,743,720 | * | 4/1998 | Sano et al. | 418/55.5 |
| 5,772,416 | * | 6/1998 | Caillat et al. | 418/55.6 |
| 5,803,716 | * | 9/1998 | Wallis et al. | 417/310 |
| 5,839,886 | * | 11/1998 | Shaw | 417/250 |
| 5,931,649 | * | 8/1999 | Caillat et al. | 418/55.1 |
| 6,017,205 | * | 1/2000 | Weatherston et al. | 418/55.6 |

FOREIGN PATENT DOCUMENTS

| | | | | |
|---|---|---|---|---|
| 0579374 | * | 1/1994 | (EP) | F04C/29/04 |

* cited by examiner

*Primary Examiner*—Teresa Walberg
*Assistant Examiner*—L. Fastovsky
(74) *Attorney, Agent, or Firm*—Harness, Dickey & Peirce, P.L.C.

(57) ABSTRACT

A scroll type compressor has both a high pressure lubricant sump and a low pressure lubricant sump. Lubricant from the low pressure lubricant sump is supplied to the various bearings, thrust surfaces and other moving components of the compressor. It is then rested in such a way that it can absorb heat from the motor windings thus maintaining the operating temperature of the motor. Lubricant from the high pressure sump is supplied to the moving compression chambers defined by the scrolls at a point intermediate suction and discharge. The lubricant supplied from the high pressure sump is first cooled and then used to cool the low pressure sump prior to being supplied to the moving compression chambers. The compressed gas is routed through two lubricant separators and a gas cooler prior to being supplied for its intended use.

38 Claims, 3 Drawing Sheets

SCROLL COMPRESSOR FOR NATURAL GAS

FIELD OF THE INVENTION

The present invention relates generally to scroll-type machinery. More particularly, the present invention relates to scroll-type machinery specifically adapted for use in the compression of natural gas.

BACKGROUND AND SUMMARY OF THE INVENTION

Scroll machines are becoming more and more popular for use as compressors in refrigeration systems as well as air conditioning and heat pump applications due primarily to their capability for extremely efficient operation. Generally, these machines incorporate a pair of intermeshed spiral wraps, one of which is caused to orbit with respect to the other so as to define one or more moving chambers which progressively decrease in size as they travel from an outer suction port towards a center discharge port. An electric motor is normally provided which operates to drive the scroll members via a suitable drive shaft.

As the popularity of scroll machines increase, the developers of these scroll machines continue to adapt and redesign the machines for compression systems outside the traditional refrigeration systems. Additional applications for scroll machines include helium compression for cryogenic applications, air compressors, natural gas compressors and the like. The present invention is directed towards a scroll machine which has been designed specifically for the compression of natural gas and/or LP gas.

The cyclic compression of natural gas presents very unique problems with respect to compressor design because of the high temperatures encountered during the compression process. The temperature rise of natural gas during the compression process can be more than twice the temperature rise encountered with the use of a conventional refrigerant. In order to prevent possible damage to the scroll machine from these high temperatures, it is necessary to provide additional cooling for the scroll machine.

The present invention comprises a scroll compressor which is specifically adapted for use in the compression of natural gas. The scroll compressor includes the conventional low pressure oil sump in the suction pressure zone of the compressor as well as a second high pressure oil sump located in the discharge pressure zone. An internal oil cooler is located within the low pressure oil sump. Oil from the low pressure oil sump is circulated to the bearings and other movable components of the compressor in a manner similar to that of conventional scroll compressors. A portion of the oil used to lubricate these moving components is pumped by a rotating component onto the windings of the electric motor to aid in cooling the motor. The oil in the high pressure oil sump is routed through an external heat exchanger for cooling and then is routed through the internal oil cooler located in the low pressure oil sump. From the internal oil cooler, the oil is injected into the compression pockets to aid in the cooling of the compressor as well as to assist in the sealing and lubrication of the intermeshed scroll wraps. An internal oil separator is provided in the discharge chamber to remove at least a portion of the injected oil from the compressed gas and replenish the high pressure oil sump. An oil overflow orifice prevents excessive accumulation of oil in the high pressure oil sump. A second external oil separator is associated with the external heat exchanger in order to remove additional oil from the natural gas to provide as close as possible for an oil free pressurized natural gas supply.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
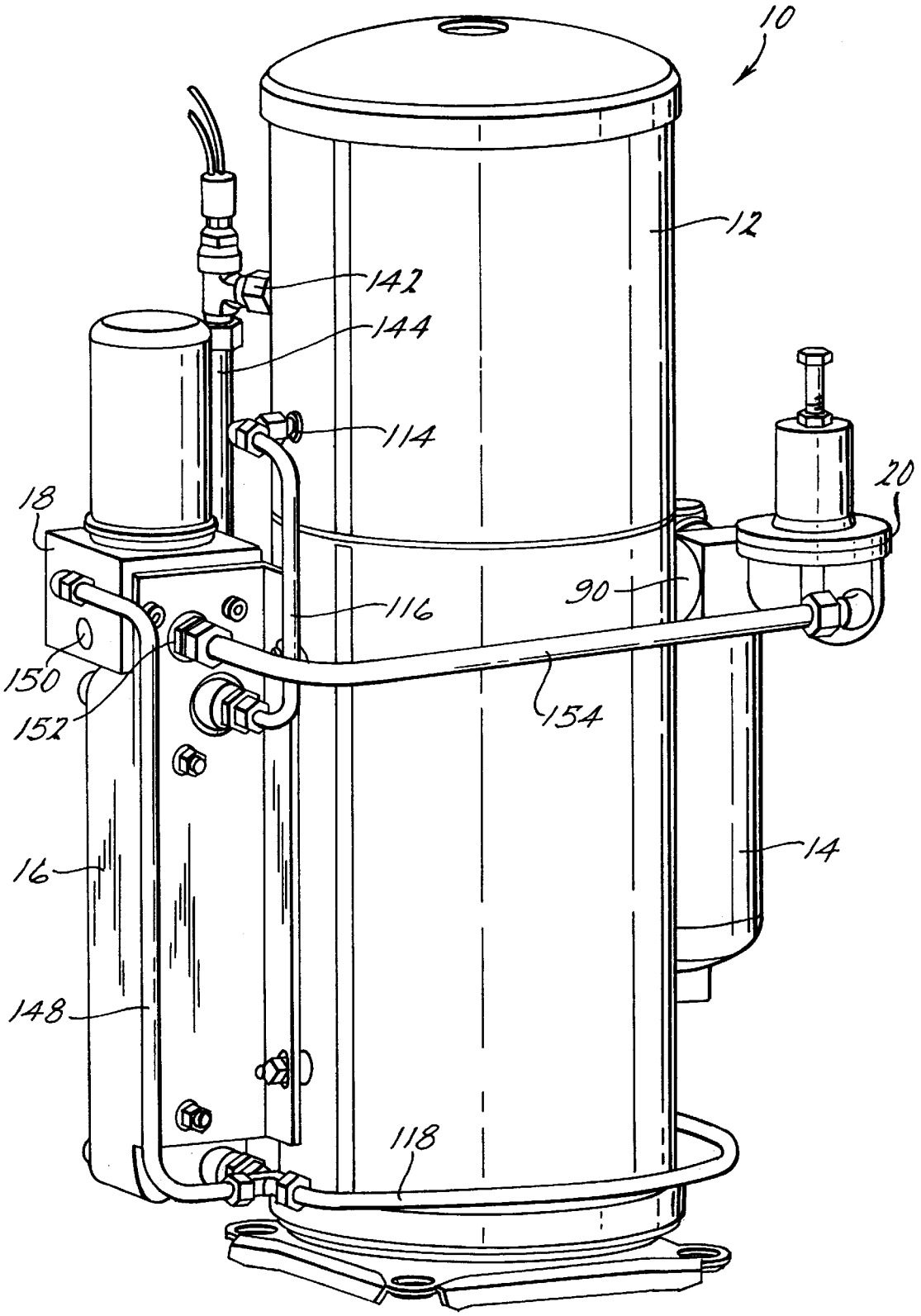
FIG. 1 is an external elevational view of the scroll machine in accordance with the present invention.
Figure 2:
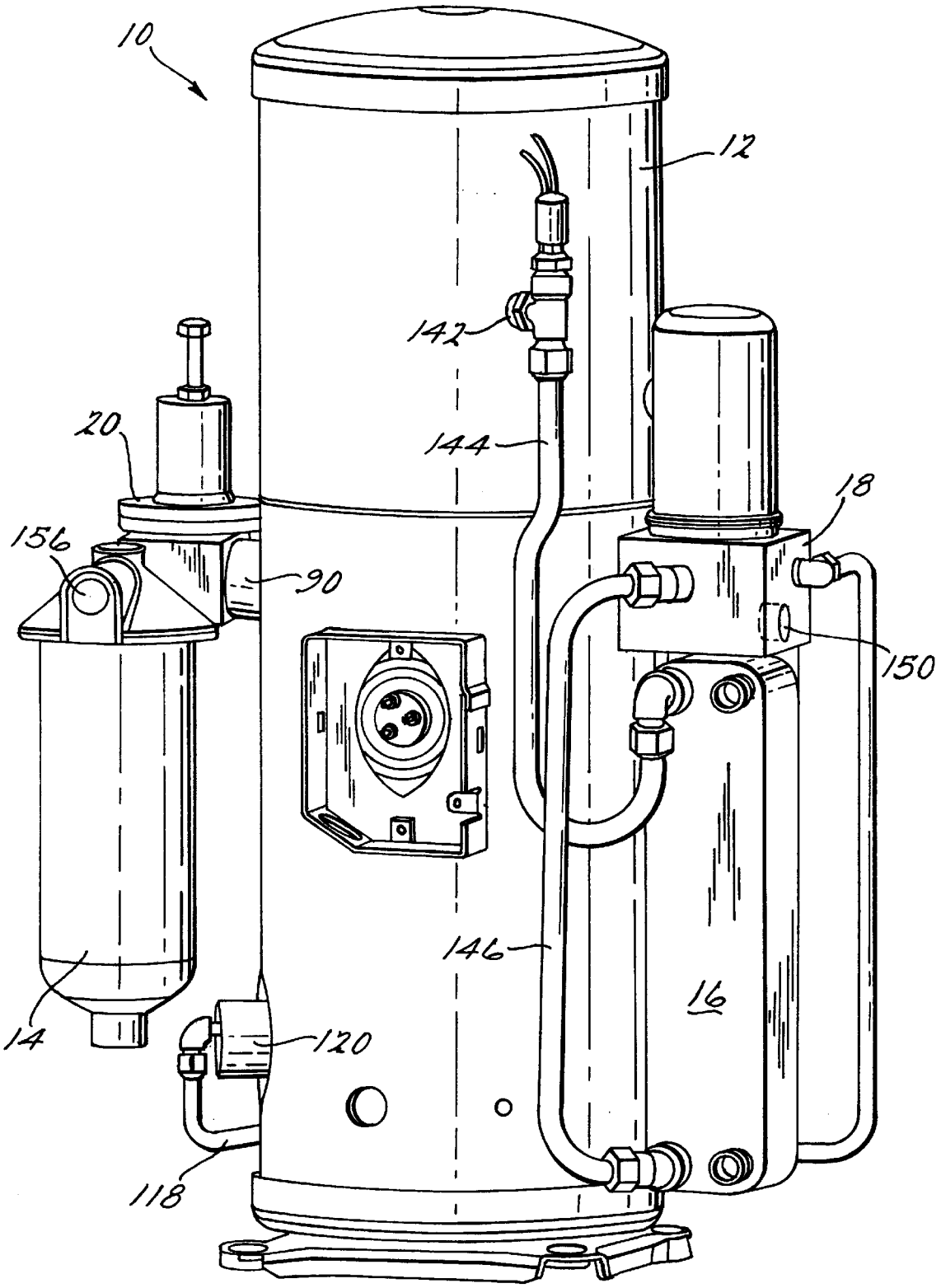
FIG. 2 is an external elevational view of the scroll machine shown in FIG. 1 in a direction opposite to that shown in FIG. 1.

Referring now to the drawings in which like reference numerals designate like or corresponding parts throughout the several views, there is shown in FIG. 1 a scroll machine in accordance with the present invention which is designated generally by the reference numeral 10. Scroll machine 10 comprises a scroll compressor 12, a filter 14, an external oil/gas cooler 16, an external oil separator 18 and a pressure regulator 20.

Figure 3:
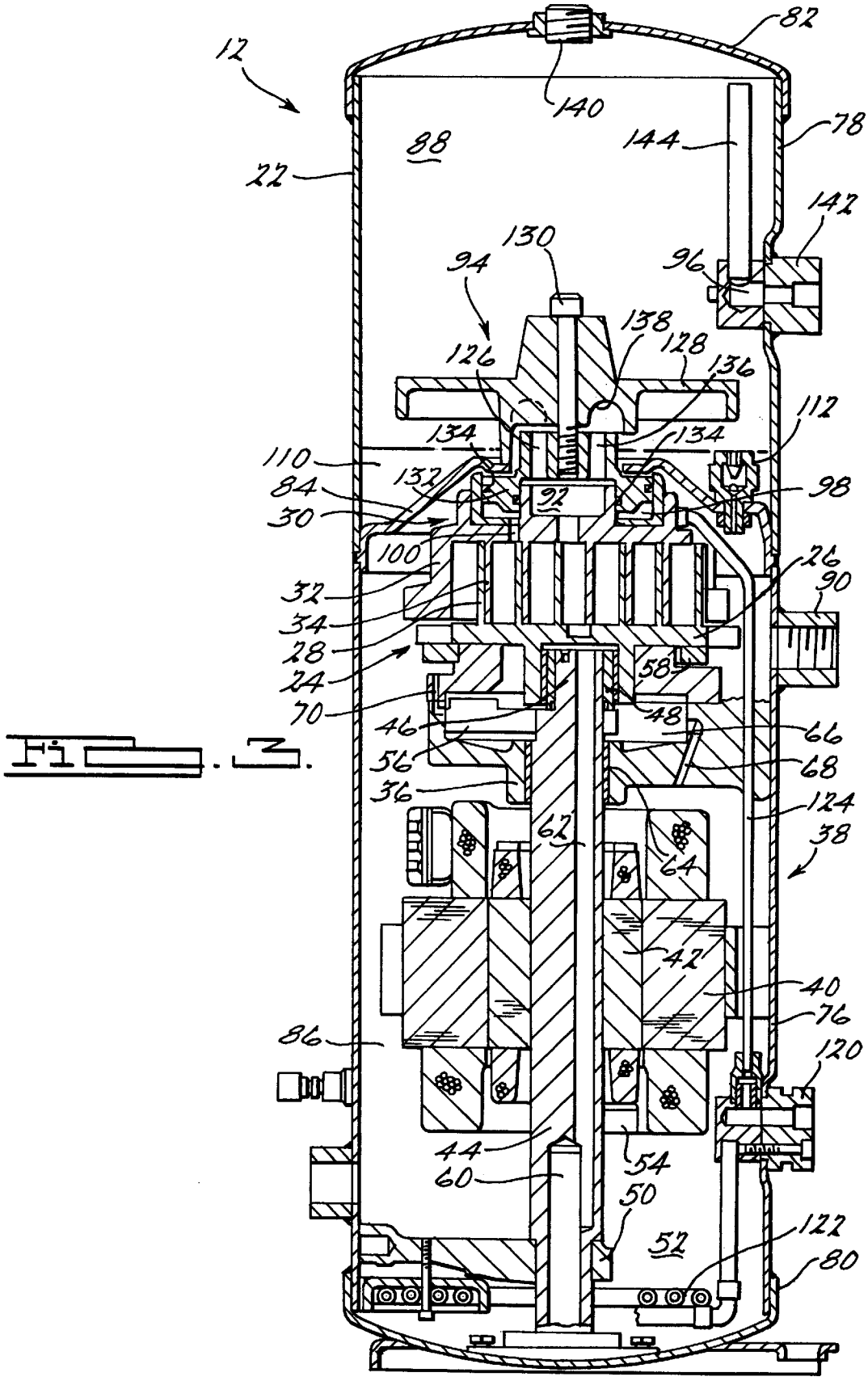
FIG. 3 is a vertical cross-sectional view of the compressor shown in FIGS. 1 and 2.

Referring to FIG. 3, compressor 12 includes an outer shell 22 within which is disposed a compressor assembly including an orbiting scroll member 24 having an end plate 26 from which a spiral wrap 28 extends, a non-orbiting scroll member 30 having an end plate 32 from which a spiral wrap 34 extends and a two-piece main bearing housing 36 supportingly secured to outer shell 22. Main bearing housing 36 supports orbiting scroll member 24 and non-orbiting scroll member 30 is axially movably secured to main bearing housing 36. Wraps 28 and 34 are positioned in meshing engagement such that as orbiting scroll member 24 orbits, wraps 28 and 34 will define moving fluid pockets that decrease in size as they move from the radially outer region of scroll members 24 and 30 toward the center region of the scroll members.

A driving motor 38 is also provided in the lower portion of shell 22. Motor 38 includes a stator 40 supported by shell 22 and a rotor 42 secured to and drivingly connected to a drive shaft 44. Drive shaft 44 is drivingly connected to orbiting scroll member 24 via an eccentric pin 46 and a drive bushing 48. Drive shaft 44 is rotatably supported by main bearing housing 36 and a lower bearing housing 50 which is secured to shell 22. The lower end of drive shaft 34 extends into an oil sump 52 provided in the bottom of shell 22. A lower counterweight 54 and an upper counterweight 56 are supported on drive shaft 34. Counterweights 54 and 56 serve to balance the rotation of drive shaft 34 and counterweight 56 acts as an oil pump as described in greater detail below. In order to prevent orbiting scroll member 24 from rotating relative to non-orbiting scroll member 30, an Oldham coupling 58 is provided. Oldham coupling 58 is supported on main bearing housing 36 and interconnecting with both orbiting scroll member 24 and non-orbiting scroll member 30.

In order to supply lubricant from oil sump 52 to the bearings and other moving components of compressor 12, an oil pump is provided in the lower end of drive shaft 44 in the form of a large axial bore 60 which serves to direct oil axially upward through an eccentric axially extending passage 62. Radial passage 64 is provided to supply lubrication oil to main bearing housing 36. The oil that is pumped through passage 62 will be discharged from the top of eccentric pin 46 to lubricate the interface between drive bushing 48 and orbiting scroll member 24. After lubricating these interfaces, the oil accumulates within a chamber 66 defined by main bearing housing 36. Upper counterweight 56 rotates within chamber 66 and acts as a pump to pump oil through a passage 68 extending through main bearing housing 36. Passage 68 receives oil from chamber 66 and routes this oil to stator 40 to aid in the cooling of the motor. Upper counterweight 56 also pumps lubricating fluid up through a passage 70 also defined by main bearing housing 36. Passage 70 receives oil from chamber 66 and directs this oil up towards Oldham coupling 58, the lower surface of end plate 26 of orbiting scroll member 24 and into the suction port formed by scroll members 24 and 30.

Outer shell 22 includes a lower shell 76, an upper shell 78, a lower cover 80 and an upper cap 82. A partition or muffler plate 84 is also provided extending across the interior of shell 22 and is sealing secured thereto around its periphery at the same point that lower shell 76 is sealingly secured to upper shell 78. Muffler plate 84 serves to divide the interior of shell 22 into a lower suction chamber 86 and an upper discharge chamber 88.

In operation, suction gas will be drawn into suction chamber 86 through a suction inlet 90 and into the moving pockets defined by scroll wraps 28 and 34. As orbiting scroll member 24 orbits with respect to non-orbiting scroll member 30, the fluid pockets will move inwardly decreasing in size and thereby compressing the fluid. The compressed fluid will be discharged into discharge chamber 88 through a discharge port 92 provided in non-orbiting scroll member 30 and a discharge fitting assembly 94 secured to muffler plate 84. The compressed fluid then exits discharge chamber 88 through a discharge outlet 96. In order to maintain axially movable non-orbiting scroll member 30 in axial sealing engagement with orbiting scroll member 24, a pressure biasing chamber 98 is provided in the upper surface of non-orbiting scroll member 30. A portion of discharge fitting assembly 94 extends into non-orbiting scroll member 30 to define chamber 98. Biasing chamber 98 is pressurized by fluid at an intermediate pressure between the pressure in the suction area and the pressure in the discharge area of compressor 12. One or more passages 100 supply the intermediate pressurized fluid to chamber 98. Chamber 98 is also pressurized by the oil which is injected into chamber 98 by the lubrication system as detailed below.

With the exception of discharge fitting assembly 94, compressor 12 as thus far described is similar to and incorporates features described in general detail in Assignee's patent numbers U.S. Pat. Nos. 4,877,382; 5,156,539; 5,102,316; 5,320,506; and 5,320,507 the disclosures of which are hereby incorporated herein by reference.

As noted above, compressor 12 is specifically adapted for compressing natural gas. The compression of natural gas results in the generation of significantly higher temperatures. In order to prevent these temperatures from being excessive, it is necessary to incorporate various systems for cooling the compressor and the compressed natural gas. In addition to the cooling for the compressor and the natural gas, it is also very important that substantially all oil be removed from the compressed gas before it is supplied to the apparatus using the compressed natural gas.

One system which is incorporated for the cooling of compressor 12 is the circulation of cooled lubricating oil. Upper shell 78 and muffler plate 84 define a sump 110 which is located within discharge chamber 88. The oil being supplied to the suction port formed by scroll members 24 and 30 through passage 70 continuously adds to the volume of oil within sump 110. An oil overflow fitting 112 extends through muffler plate 84. Fitting 112 has an oil over flow orifice which keeps the level of oil in sump 110 at the desired level. Oil in sump 110 is routed through an outlet fitting 114 (FIG. 1) extending through upper shell 78 and into oil/gas cooler 16 by a connecting tube 116. The cooled oil exits oil/gas cooler 16 through a connecting tube 118 and enters lower shell 76 through an inlet fitting 120. Oil entering fitting 120 is routed through a heat exchanger in the form of a cooling coil 122 which is submerged within oil sump 52. The oil circulates through cooling coil 122 cooling the oil in oil sump 52 and is returned to inlet fitting 120. Oil entering inlet fitting 120 from coil 122 is directed to biasing chamber 98 through a connecting tube 124. The oil enters biasing chamber 98 where it enters the compression chambers formed by wraps 28 and 34 through port 100 to cool compressor 12 as well as assisting in the sealing and lubricating of wraps 28 and 34. The oil injected into the compression chambers is carried by the compressed gas and exits the compression chambers with the natural gas through discharge port 92 and discharge fitting assembly 94.

Discharge fitting assembly 94 includes a lower seal fitting 126 and an upper oil separator 128 which are secured together sandwiching muffler plate 84 by a bolt 130. Lower seal fitting 126 sealingly engages and is located below muffler plate 84 and it includes an annular extension 132 which extends into non-orbiting scroll member 30 to close and define biasing chamber 98. A pair of seals 134 isolate chamber 98 from both suction chamber 86 and discharge chamber 88. Lower seal fitting 126 defines a plurality of discharge passages 136 which receive compressed natural gas from discharge port 92 and direct the flow of the compressed natural gas towards oil separator 128. Oil separator 128 is disposed above muffler plate 84. Compressed natural gas exiting discharge passages 136 contacts a lower contoured surface 138 of oil separator 128 and is redirected prior to entering discharge chamber 88. The contact between the compressed natural gas and surface 138 causes the oil within the gas to separate and return to sump 110. During the assembly of compressor 12, lower seal fitting 126 and upper oil separator 128 are attached to muffler plate 84 by bolt 130. Bolt 130 is not tightened until the rest of the components of compressor 12 are assembled and secured in place. Once this has been accomplished, bolt 130 is tightened. Access to bolt 130 is provided by a fitting 140 extending through cap 82. Once bolt 130 is tightened, fitting 140 is sealed to isolate discharge chamber 88.

Compressed natural gas exits discharge chamber 88 through discharge outlet 96. Discharge outlet 96 includes a discharge fitting 142 and an upstanding pipe 144. Discharge fitting 142 extends through upper shell 78 and upstanding pipe 144 extends toward cap 82 such that the compressed natural gas adjacent cap 82 is directed out of discharge chamber 88. By accessing the compressed natural gas adjacent cap 82, the gas with the least amount of oil contained in the gas is selectively removed. Compressed natural gas exiting discharge chamber 88 through outlet 96 is routed to oil/gas cooler 16 through a connecting pipe 144. Oil/gas cooler 16 can be a liquid cooled cooler using Glycol or other liquids known in the art as the cooling medium or oil/gas cooler 16 can be a gas cooled cooler using air or other gases known in the art as the cooling medium if desired. The cooled compressed natural gas exits oil/gas cooler 16 through a connecting pipe 146 and is routed to oil separator 18. Oil separator 18 removes substantially all of the remaining oil from the compressed gas. This removed oil is directed back into compressor 12 by a connecting tube 148 which connects oil separator 18 with connecting tube 118. The oil free compressed and cooled natural gas leaves oil separator 18 through an outlet 150 to which the apparatus using the natural gas is connected. An accumulator may be located between outlet 150 and the apparatus using the natural gas if desired. A second outlet 152 for the natural gas is connected to pressure regulator 20 by a connecting pipe 154. Pressure regulator 20 controls the outlet pressure of natural gas at outlet 150. Pressure regulator 20 is connected to filter 14 and filter 14 includes an inlet 156 to which is connected the uncompressed source of natural gas.

Thus, uncompressed gas is piped to inlet 156 of filter 14 where it is supplied to suction inlet 90 and thus suction chamber 86 along with gas rerouted to suction inlet 90 and suction chamber 86 through pressure regulator 20. The gas in suction chamber 86 enters the moving pockets defined by wraps 28 and 34 where it is compressed and discharged through discharge port 92. During the compression of the gas, oil is mixed with the gas by being supplied to the compression chambers from biasing chamber 98 through passages 100. The compressed gas exiting discharge port 92 impinges upon upper oil separator 128 where a portion of the oil is removed from the gas prior to the gas entering discharge chamber 88. The gas exits discharge chamber 88 through discharge outlet 96 and is routed through oil/gas cooler 16 and then into oil separator 18. The remaining oil is separated from the gas by oil separator 18 prior to it being delivered to the appropriate apparatus through outlet 150. The pressure of the gas at outlet 150 is controlled by pressure regulator 20 which is connected to oil separator 18 and to suction chamber 86.

In addition to the temperature problems associated with the compression of the natural gas, there are problems associated with various components of or contaminants within the natural gas such as hydrogen sulfide ($H_25$). All polyester based materials degrade and are thus not acceptable for use in any natural gas application. One area which is of a particular concern is the individual components of motor stator 40.

Motor stator 40 includes a plurality of windings 200 which are typically manufactured from copper. For the compression of natural gas, windings 200 are manufactured from aluminum in order to avoid the degradation of windings 200 from the natural gas. In addition to the change of the material of the coil windings itself, the following table lists the other components of stator 40 which require revision in order to improve their performance when compressing natural gas.

| Item | Current Material | Natural Gas Material |
|---|---|---|
| Varnish | PD George 923<br>PD George 423<br>Schenectady 800P | Guardian GRC-59 |
| Tie Cord | Dacron | Nomex<br>Cotton<br>Nylon treated w/ acrylic |
| Phase Insulation | Mylar | Nomex<br>Nomex-Kapton-Nomax |

-continued

| Item | Current Material | Natural Gas Material |
|---|---|---|
| Slot Liner | Mylar | Nomex<br>Nomex-Kapton-Nomax |
| Soda Straw | Mylar | Teflon |
| Lead Wire Insulation | Dacron and Mylar (DMD) | Hypalon |
| Lead Wire Tubing | Mylar | Teflon |
| Terminal Block | Valox 310 | Vitem 1000-7100<br>Fibcrite 400S-464B<br>Ultrason E2010G4 |

The above modification for the materials reduces and/or eliminates degradation of these components when they are utilized for compressing natural gas.

While the above detailed description describes the preferred embodiment of the present invention, it should be understood that the present invention is susceptible to modification, variation and alteration without deviating from the scope and fair meaning of the subjoined claims.

What is claimed is:

1. A compressor comprising:

a shell defining a suction pressure zone and a discharge pressure zone;

a compressing mechanism disposed within said shell, said compressing mechanism defining at least one compression chamber for compressing a gas;

a low pressure lubricant sump disposed within said shell;

a high pressure lubricant sump disposed within said shell;

a lubricant flow path for supplying lubricant from said high pressure lubricant sump to said compression chamber;

a first lubricant separator disposed within said shell, said first lubricant separator being operative to separate lubricant from said compressed gas and returning said lubricant to said high pressure lubricant sump;

a fluid passage extending between said discharge pressure zone and said suction pressure zone; and a device disposed within said fluid passage, said device controlling gas pressure within said discharge pressure zone by controlling fluid flow from said discharge pressure zone to said suction pressure zone through said fluid passage.

2. The compressor according to claim 1, further comprising a heat exchanger disposed within said low pressure lubricant sump.

3. The compressor according to claim 2, wherein said heat exchanger forms a portion of said lubricant flow path.

4. The compressor according to claim 2, further comprising a gas cooler for cooling said compressed gas.

5. The compressor according to claim 4, wherein said gas cooler is disposed outside said shell.

6. The compressor according to claim 4, further comprising lubricant cooler forming a portion of said lubricant flow path.

7. The compressor according to claim 6, wherein said lubricant cooler is disposed outside said shell.

8. The compressor according to claim 6, further comprising a second lubricant separator, said second lubricant separator being operative to separate lubricant from said compressed gas and returning said lubricant to said high pressure lubricant sump.

9. The compressor according to claim 8, wherein said second lubricant separator is disposed outside said shell.

10. The compressor according to claim 8, wherein said device is a pressure regulator for controlling said gas pressure within said discharge pressure zone.

11. The compressor according to claim 10, wherein said pressure regulator is disposed outside said shell.

12. The compressor according to claim 10, further comprising a filter in communication with said compressing mechanism.

13. The compressor according to claim 12, wherein said filter is disposed outside said shell.

14. The compressor according to claim 12, wherein said compressing mechanism defines an inlet, said filter being in communication with said inlet of said compressor.

15. The compressor according to claim 1, further comprising a gas cooler for cooling said compressed gas.

16. The compressor according to claim 15, wherein said gas cooler is disposed outside said shell.

17. The compressor according to claim 1, further comprising lubricant cooler forming a portion of said lubricant flow path.

18. The compressor according to claim 17, wherein said lubricant cooler is disposed outside said shell.

19. The compressor according to claim 1, further comprising a second lubricant separator, said second lubricant separator being operative to separate lubricant from said compressed gas and returning said lubricant to said high pressure lubricant sump.

20. The compressor according to claim 19, wherein said second lubricant separator is disposed outside said shell.

21. The compressor according to claim 1, wherein said device is a pressure regulator for controlling said gas pressure within said discharge chamber.

22. The compressor according to claim 21, wherein said pressure regulator is disposed outside said shell.

23. The compressor according to claim 1, further comprising a filter in communication with said compressing mechanism.

24. The compressor according to claim 23, wherein said filter is disposed outside said shell.

25. The compressor according to claim 23, wherein said compressing mechanism defines an inlet, said filter being in communication with said inlet of said compressor.

26. The compressor according to claim 1, wherein said compressing mechanism is a scroll compressor, said scroll compressor comprising:

a first scroll member disposed in said shell and including a first end plate having a first spiral wrap thereon;

a second scroll member disposed within said shell and including a second end plate having a second spiral wrap thereon, said first and second spiral wraps being intermeshed to create said at least one compression chamber;

a drive member for causing said scroll members to orbit relative to one another such that said at least one compression chamber progressively changes volume between said suction pressure zone and said discharge pressure zone.

27. The compressor according to claim 1, wherein said low pressure lubricant sump is disposed within said suction pressure zone.

28. The compressor according to claim 27, wherein said high pressure lubricant sump is disposed within said discharge pressure zone.

29. The compressor according to claim 1, wherein said high pressure lubricant sump is disposed within said discharge pressure zone.

30. The compressor according to claim 1, wherein said suction pressure zone is at a suction pressure and said discharge pressure zone is at a discharge pressure, said lubricant being supplied to said compression chamber when a pressure within said compression chamber is intermediate said suction pressure and said discharge pressure.

31. A compressor comprising:

a shell defining a suction pressure zone and a discharge pressure zone;

a compressing mechanism disposed within said shell, said compressing mechanism defining at least one compression chamber for compressing a gas;

a low pressure lubricant sump disposed within said shell;

a high pressure lubricant sump disposed within said shell;

a lubricant flow path for supplying lubricant from said high pressure lubricant sump to said compression chamber;

a heat exchanger disposed within said low pressure sump;

a fluid passage extending between said discharge pressure zone and said suction pressure zone; and a device disposed within said fluid passage, said device controlling gas pressure within said discharge pressure zone by controlling fluid flow from said discharge pressure zone to said suction pressure zone through said fluid passage.

32. The compressor according to claim 31, wherein said heat exchanger forms a portion of said lubricant flow path.

33. The compressor according to claim 31, wherein said compressing mechanism is a scroll compressor, said scroll compressor comprising:

a first scroll member disposed in said shell and including a first end plate having a first spiral wrap thereon;

a second scroll member disposed within said shell and including a second end plate having a second spiral wrap thereon, said first and second spiral wraps being intermeshed to create said at least one compression chamber;

a drive member for causing said scroll members to orbit relative to one another such that said at least one compression chamber progressively changes volume between said suction pressure zone and said discharge pressure zone.

34. The compressor according to claim 31, wherein said suction pressure zone is at a suction pressure and said discharge pressure zone is at a discharge pressure, said lubricant being supplied to said compression chamber when a pressure within said compression chamber is intermediate said suction pressure and said discharge pressure.

35. A compressor comprising:

a shell defining a suction pressure zone and a discharge pressure zone;

a compressing mechanism disposed within said shell, said compressing mechanism defining at least one compression chamber for compressing a gas;

a low pressure lubricant sump disposed within said shell;

a high pressure lubricant sump disposed within said shell;

a lubricant flow path for supplying lubricant from said high pressure lubricant sump to said compression chamber;

a lubricant cooler forming a portion of said lubricant flow path;

a fluid passage extending between said discharge pressure zone and said suction pressure zone; and a device disposed within said fluid passage, said device controlling gas pressure within said discharge pressure zone by controlling fluid flow from said discharge pressure zone to said suction pressure zone through said fluid passage.

36. The compressor according to claim 35, wherein said suction pressure zone is at a suction pressure and said discharge pressure zone is at a discharge pressure, said lubricant being supplied to said compression chamber when a pressure within said compression chamber is intermediate said suction pressure and said discharge pressure.

37. The compressor according to claim 35, wherein said lubricant cooler is disposed outside said shell.

38. The compressor according to claim 35, wherein said compressing mechanism is a scroll compressor, said scroll compressor comprising:

a first scroll member disposed in said shell and including a first end plate having a first spiral wrap thereon;

a second scroll member disposed within said shell and including a second end plate having a second spiral wrap thereon, said first and second spiral wraps being intermeshed to create said at least one compression chamber;

a drive member for causing said scroll members to orbit relative to one another such that said at least one compression chamber progressively changes volume between said suction pressure zone and said discharge pressure zone.

* * * * *

UNITED STATES PATENT AND TRADEMARK OFFICE

CERTIFICATE OF CORRECTION

PATENT NO. : 6,257,840 B1
DATED : July 10, 2001
INVENTOR(S) : Kirill M. Ignatiev, James F. Fogt, Kenneth L. Feathers It is certified that error appears in the above-identified patent and that said Letters Patent is hereby corrected as shown below:

Title page,
Under Attorney, Agent, or Firm, "Peirce" should be -- Pierce --.

Column 2,
Line 18, "EMBODIMENTS" should be -- EMBODIMENT --.

Column 3,
Line 20, "sealing" should be -- sealingly --.

Signed and Sealed this

Second Day of April, 2002

*Attest:*

*Attesting Officer*

JAMES E. ROGAN
*Director of the United States Patent and Trademark Office*